US006391477B1

(12) United States Patent
Koslov et al.

(10) Patent No.: US 6,391,477 B1
(45) Date of Patent: May 21, 2002

(54) ELECTROLESS AUTOCATALYTIC PLATINUM PLATING

(75) Inventors: Alexander S. Koslov, Wharton; Thirumalai Palanisamy, Morristown; Dave Narasimhan, Flemington, all of NJ (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 09/611,183

(22) Filed: Jul. 6, 2000

(51) Int. Cl.[7] ..... C09D 5/00; B05D 1/00; B32B 15/01

(52) U.S. Cl. ..... 428/670; 427/125; 427/437; 427/443.1; 106/1.21; 106/1.28

(58) Field of Search ..... 427/125, 98, 437, 427/443.1; 106/1.24, 1.21, 1.28; 428/668, 670

(56) References Cited

U.S. PATENT DOCUMENTS

| | | | | |
|---|---|---|---|---|
| 3,562,911 A | | 2/1971 | Walter et al. | 32/8 |
| 4,285,784 A | | 8/1981 | Flinn et al. | 204/39 |
| 4,361,602 A | | 11/1982 | Torikai et al. | 427/123 |
| 5,865,881 A | * | 2/1999 | Mori et al. | 106/1.28 |
| 5,980,345 A | * | 11/1999 | Chang et al. | 445/7 |
| 6,165,912 A | * | 12/2000 | McConnell et al. | 438/758 |

FOREIGN PATENT DOCUMENTS

| | | | |
|---|---|---|---|
| DE | 2607988 A1 | | 8/1977 |
| JP | 204168-1983 | | 11/1983 |
| JP | 80764-1984 | * | 5/1984 |
| JP | 60-92494 A | * | 5/1985 |

OTHER PUBLICATIONS

Griffith, William et al. "GMELIN Handbook Of Inorganic Chemistry", Springer–Verlag; 1984; pp. 126–127; 152–153.
Lowenheim, Frederick, A; "Modern Electroplating", John Wiley, And Sons; pp. 710, 720–721, No Date Provided.

* cited by examiner

*Primary Examiner*—Michael Barr
(74) *Attorney, Agent, or Firm*—Kris T. Frederick

(57) ABSTRACT

This invention relates to electroless autocatalytic plating of platinum onto a substrate, an aqueous platinum plating bath, a process for plating a uniform coating of platinum onto various substrates using an electroless autocatalytic plating composition, and a platinum plated article formed therefrom. The plating bath of this invention allows direct autocatalytic plating of platinum on catalytically active and inactive, conductive and non-conductive substrates, avoiding the extra costs of activating a catalytically inactive substrate.

26 Claims, No Drawings

ELECTROLESS AUTOCATALYTIC PLATINUM PLATING

BACKGROUND OF THE INVENTION

1. Field of the Invention

This invention relates to electroless plating of platinum onto a substrate. More particularly, this invention pertains to an aqueous platinum plating bath, a process for plating a uniform coating of platinum onto various substrates using an electroless plating composition, and a platinum plated article formed therefrom.

2. Description of the Related Art

Plating of metals is a well known process employed to alter the existing surface properties or dimensions of a substrate. For example, a substrate may be plated for decorative purposes, to improve resistance to corrosion or abrasion, or to impart desirable electrical or magnetic properties to a substrate. Plating is a common practice in many industries, including the manufacture of a variety of electronic packaging substrates, such as printed circuit boards.

There are various methods of plating known in the art, including electroplating and electroless plating. Electroplating involves the formation of an electrolytic cell wherein a plating metal represents an anode and a substrate represents a cathode, and an external electrical charge is supplied to the cell to facilitate the coating of the substrate.

Electroless plating involves the deposition of a metallic coating from an aqueous bath onto a substrate by a controlled chemical reduction reaction which is catalyzed by the metal or alloy being deposited or reduced. This process differs from electroplating in that it requires no external electrical charge. One attractive benefit of electroless plating over electroplating is the ability to plate a substantially uniform metallic coating onto a substrate having an irregular shape. Frequently, electroplating an irregularly shaped substrate produces a coating having a non-uniform deposit thickness because of varying distances between the cathode and anode of the electrolytic cell. Electroless plating obviates this problem by excluding the electrolytic cell. Another benefit of electroless plating over electroplating is that electroless plating is autocatalytic and continuous once the process is initiated, requiring only occasional replenishment of the aqueous bath. Electroplating requires an electrically conductive cathode and continues only while an electric current is supplied to the cell. Also, electroless coatings are virtually nonporous, which allows for greater corrosion resistance than electroplated substrates.

In general, an electroless plating bath includes water, a water soluble compound containing the metal to be deposited onto a substrate, a complexing agent that prevents chemical reduction of the metal ions in solution while permitting selective chemical reduction on a surface of the substrate, and a chemical reducing agent for the metal ions. Additionally, the plating bath may include a buffer for controlling pH and various optional additives, such as bath stabilizers and surfactants. The composition of a plating bath typically varies based on the particular goals of the plating process. For example, U.S. Pat. No. 6,042,889, teaches an electroless plating bath and having a hypophosphite reducing agent and employing one of several different "mediator ions", including platinum ions, for the purpose of converting a non-autocatalytic metal-reduction reaction into an autocatalytic reaction to plate a substrate with copper.

Platinum is a desirable plating metal for its excellent physical and chemical properties, but present techniques for electroless autocatalytic plating with platinum and other non-ferrous or precious metals require a catalytic substrate material. Non-catalytic substrate materials, such as lead, cadmium, bismuth, tin, glass, and ceramics can only be electroplated in an autocatalytic bath after the substrate surface has been catalytically activated. (See, for example, *Modern Electroplating*, Third Edition, Edited by Fla. Lowenheim, John Wiley & Sons, New York, 1974, pp. 710, 720, 721). A non-conductive substrate can be activated by using methods such as firing, or sputtering, or immersion in a tin-palladium solution to place a thin layer of a catalytic metal onto the substrate. Conductive substrate can also be activated by electroplating with a catalytic metal like copper, nickel, gold or silver. However, all these methods of catalytic activation (except the tin-palladium method) can not provide uniform activation of irregular surface. Also, the catalytic activation step significantly adds to the cost of the plating process.

Also, prior art processes for the electroless plating of platinum onto a catalytically active base metal substrate has not been very efficient. According to U.S. Pat. No. 3,562,911, electroless platinum plating in a solution of hexachloroplatinic acid $H_2PtCl_6$ in hydrochloric acid HCl with hydrazine dihydrochloride $N_2H_4$*2HCl can be done only on metals which are more noble than copper, typically on palladium, gold and silver. In the presence of less noble metals like iron, nickel and their alloys, the plating bath rapidly decomposes to platinum powder because of poor stability of hexachloroplatinic acid at these conditions. Plating on non-conductors in this bath requires a catalytic activation of a substrate.

Japanese Kokai Patent Publication No. 80764 teaches an electroless plating bath of platinum or a platinum-palladium alloy comprising a platinum nitro complex salt $M_2[Pt(NO_2)_4]$ (M=Na, K) and/or nitro ammine complex salt $Pt(NH_3)_2(NO_2)_2$ (DNP salt), ammonium hydroxide as a stabilizer and pH regulator, hydroxylamine chloride $NH_2OH$*HCl as a stabilizer, hydrazine hydrate $N_2H_4$*$H_2O$ as; a reducer and wherein the pH of the bath must remain from 10 to about 18 to plate a substrate with platinum. This process is based on a strong ammonia solution of a platinum salt and a hydrazine reducer at pH>10. At pH<9 the bath decomposes to Pt powder. Since many metals and metal alloys are passivated by ammonia solution, electroless deposition of Pt in the presence of ammonia is difficult. For instance, plating even on catalytically active metals like copper and nickel in this solution still requires a preliminary activation by a dip in a palladium or rhodium chloride acid solution. It is well known that such activation is based on an electrochemical displacement mechanism, and provides highly porous, non-adherent films. Plating on non-conductors by the process of Japanese Kokai Patent Publication No. 80764 also requires a preliminary catalytic activation.

It has been known that $M_2[Pt(NO_2)_4]$ (M=Na, K) and DNP salt are decomposed by 10–40% solutions of strong acids HCl, $HNO_3$ and $H_2SO_4$ (JP08176175, JP06178936, GB1325818, Chem. Abstr. 1966, 66:34406). Surprisingly, it has been found that at a pH of about 7 or below and in the absence of the ammonia stabilizer, platinum salt $M_2[Pt(NO_2)_4$ and DNP salt are sufficiently stable, and in the presence of hydrazine reducer produce good coatings from solutions which are stable and clear. It has also been surprisingly found that the bath is effective not only on materials which are normally difficult to plate, but also on non-catalytic materials such as glass and non-wet graphite.

The present invention solves the problems of the prior art by providing a process for electroless autocatalytic deposition of platinum on catalytically inactive materials using a composition comprising an acidic aqueous plating bath comprising a water soluble platinum salt such as platinum nitrite or platinum ammine nitrite salt, hydrazine hydrate as a reducing agent and adjusting the bath, such as with an acid sufficient to maintain it at a pH of about 7 or less. The preferred pH of the inventive plating solution ranges from about 0.5 to about 7, while the pH of prior art method, Japanese Kokai Patent Publication No. 80764 ranges from about 10 to about 18, however, such require the presence of ammonia water. This process provides a substantial cost reduction over prior art methods.

The composition of this aqueous solution is free of non-volatile components that cause impure plating, allowing for improved appearance and properties of the plated platinum. Further, the process generates essentially no hazardous substances and the absence of non-volatile components avoids the accumulation of byproducts that degrade the plating bath, allowing for virtually unlimited replenishment of the bath. Moreover, the unique composition of the plating bath allows metallic platinum to be precipitated from the plating bath by boiling without undesirable contaminants.

This invention provides a simple low-cost method of a deposition of ultra pure platinum coatings on virtually any material of any geometrical shape, including fibers and powders, by electroless autocatalytic plating. The method involves the controlled autocatalytic chemical reduction of a platinum salt by a chemical reducer with the formation of a dense uniform metallic platinum coating of unlimited thickness selectively on the substrate surface which is contacted with a platinum plating bath.

SUMMARY OF THE INVENTION

This invention provides an electroless plating composition comprising an aqueous solution comprising:

a) a water soluble platinum salt; and b) hydrazine hydrate;

wherein said composition has a pH of about 7 or less.

This invention also provides a process for plating a substrate comprising:

A) providing a plating composition comprising an aqueous solution comprising:

a) a water soluble platinum salt; and b) hydrazine hydrate;

wherein said composition has a pH of about 7 or less; and

B) contacting a substrate with the plating composition for a sufficient time and under conditions sufficient to plate metallic platinum onto the substrate.

This invention further provides process for plating a substrate comprising:

A) providing a plating composition comprising an aqueous solution comprising:

a) a water soluble platinum salt; and b) hydrazine hydrate;

wherein said composition has a pH of about 7 or less;

B) immersing a substrate into the plating composition for a sufficient time and under conditions sufficient to plate metallic platinum onto the substrate; and C) removing the substrate from the plating composition.

This invention still further provides an article comprising a substrate immersed in a composition comprising an aqueous solution comprising:

a) a water soluble platinum salt; and b) hydrazine hydrate;

wherein said composition has a pH of about 7 or less.

DETAILED DESCRIPTION OF THE PREFERRED EMBODIMENTS

The present invention provides a process for uniformly plating various substrates with metallic platinum using an electroless plating bath. Initially, an aqueous plating bath comprising water, a water soluble platinum nitrite or platinum ammine nitrite salt, a hydrazine reducer and optional acid is formed in a suitable container. Once all of the components are combined in a suitable container, the platinum salt dissolves, releasing complex platinum ions or molecules into the bath. The hydrazine reducer allows reduction of the complex platinum ions or molecules to metallic platinum which is deposited on a substrate surface. The acid is employed to maintain the plating bath at the desired pH level.

In particular, after a substrate is immersed in the plating bath, the substrate surface catalyzes oxidation of the reducing agent. This oxidation causes a release of electrons that, in turn, reduce metal platinum ions in the bath at the substrate surface. These reduced metal ions are then deposited onto the substrate and, over time, generate a metal shell around the substrate. Chemical reduction of the platinum salt by the hydrazine results in the formation of only metallic platinum and highly volatile gaseous byproducts ($N_2$, $H_2O$ and $NH_3$) which are removed from the plating bath by evaporation. Other bath constituents, including $N_2H_4.H_2O$, are also highly volatile and can be similarly removed through evaporation. The bath contains no substances capable of accumulating in the container and suppressing the platinum plating process, and creates no hazardous substances. The plating composition is highly stable and does not require the addition of non-volatile stabilizers, accelerators, or other chemical agents used to enhance plating properties. Also, because no strong complexing agents are included or generated by the bath, simple boiling of the bath is sufficient to precipitate virtually pure platinum from the aqueous solution.

The process is autocatalytic, in that no catalyst separate from the aforementioned components is required to advance the platinum deposition onto catalytically active surfaces, like base and noble metals, alloys, and graphite. The bath is also capable of directly plating inactive surfaces like glass, ceramics and polymers. Additionally, the process is continuous and may be maintained for virtually an infinite time by merely replenishing each of the components of the bath.

Following formation of the plating bath, a suitable substrate is immersed in the bath for plating. The substrate remains in the plating solution for a time sufficient and under conditions sufficient to plate a substantially uniform coating of metallic platinum of required thickness onto the substrate. Usually the plating rate is about 0.1 to 2 microns/hour. This rate increases with increasing bath temperature and the concentration of platinum and hydrazine.

The bath is preferably maintained at a temperature ranging from about 15° C. to about 98° C. more preferably from about 60° C. to about to 90° C. The bath is at pH of about 7 or below, preferably from about 0.5 to about 7, more preferably from about 2.0 to about 6.8 and most preferably from about 3 to about 6.

Further, the bath is preferably formed in the absence of any other additives since such would tend to accumulate in the bath. These conditions are important factors in maintaining a stable plating bath and preventing precipitation of platinum from the bath.

Typically the substrate remains in the plating bath for from about 1 minute to about four hours depending on the required platinum thickness preferably from about 5 minutes to about 60 minutes and most preferably from about 5 minutes to about 30 minutes. After the desired amount of metallic platinum has been coated on the substrate, it is removed from the plating solution. The result is an article having a substantially uniform and virtually pure metallic platinum plating, having good appearance and properties. Plating can also be done by contacting a substrate surface with a plating bath by any other technique such as spraying, pouring, brushing, etc.

In the preferred embodiment of the invention, the water soluble platinum salt comprises a platinum nitrite salt, a platinum ammine nitrite and combinations thereof Suitable are platinum nitrite or/and ammine-nitrite salts of the general formula $M_z[Pt(NH_3)_x(NO_2)_{(4-x)}](NO_2)_y$, where M=alkali metal or $NH_4$; z, y=≧0, x=0 to 4. Of these, the most preferred platinum salt is diamminebis(nitrito-N,N) platinum (II), or $Pt(NH_3)_2(NO)_2$ (DNP salt). Diamminebis (nitrito-N,N) platinum (II) can be synthesized, for example, by reacting a $Pt(NH_3)_2Cl_2$ aqueous suspension with $NaNO_2$. The amount of platinum salt present in the bath preferably ranges from about 0.01 to about 120 g/L. More preferably, the amount of platinum salt from about 0.1 to about 5 g/L.

The reducing agent is preferably a hydrazine compound. The most preferable hydrazine is hydrazine hydrate ($N_2H_4.H_2O$). Other suitable hydrazines include hydrazine chloride and hydrazine sulfate, but are not preferred because of the greater probability that platinum will precipitate out of the bath. The preferred amount of hydrazine hydrate present ranges from about 0.01 to about 240 g/L, more preferably from about 0.1 to about 10 g/L.

The preferred acids for the purposes of this invention generally include acetic acid nitric acid and combinations thereof The preferred amount of acid is any amount sufficient to maintaining the pH of the bath within the range mentioned above.

The substrate may comprise any material ranging from non-metals, metals, alloys, semiconductors and non-conductors. Suitable metal substrates include stainless steel, carbon steel, nickel, iron, chromium, iron-chromium alloys, and nickel-chromium-iron alloys. Suitable non-metals include printed circuit boards, polyimide substrates, ceramic and glass substrates.

The type of container used to form the plating bath is also an important factor affecting the stability of the bath. In particular, the container should be non-metallic to prevent reduction of the metal ions on the walls of the container. Additionally, means used to heat the bath should be a non-metallic heating system, and should heat the bath uniformly to prevent any reductions of metal ions in the bath.

The following non-limiting examples serve to illustrate the invention.

COMPARATIVE EXAMPLE 1

An Inconel X750 washer OD21×ID11×H7 mm was polished with a sandpaper Grit 400 and immersed in an electroless platinum (Pt) plating bath of JP 59080764. This bath contains 2 g/L Pt as DNP salt, 125 mL/L of 28% $NH_4OH$ and 37 g/L $N_2H_4.H_2O$ at pH 11 and 50° C. for 2 hours. No Pt plating was detected because of poor catalytic activity at the Inconel surface.

EXAMPLE 1

An Inconel X750 washer was immersed in an electroless Pt plating bath according to this invention. This bath contains 2 g/L Pt as DNP salt, 3 g/L $N_2H_4.H_2O$ and acetic acid $CH_3COOH$ and was adjusted to pH 3. Plating was done at 50° C. for 1 hour. A semi-bright, dense, uniform, adherent and catalytically active Pt coating of 0.1 micrometers (micron) thick was obtained and built-up to 10 micron. Such Pt coating is useful as a supported catalyst and a high temperature low friction, corrosion resistant component of aerospace turbomachinery.

COMPARATIVE EXAMPLE 2

A coupon of HS25 cobalt superalloy 25×25×0.125 mm was polished with sandpaper Grit 400 and immersed in an electroless Pt plating bath of the prior art as described in Comparative Example 1. Platinum plating was detected only as separate spots on about 50% of the surface area. At a thickness of 0.3 micron this Pt coating peeled out because of poor catalytic activity of the HS25 surface.

EXAMPLE 2

A coupon of HS25 cobalt superalloy was immersed in an electroless Pt plating bath according to this invention. This bath contains 1 g/L Pt as DNP salt, 1 g/L $N_2H_4.H_2O$ and acetic acid $CH_3COOH$ and was adjusted to pH 6.8. Plating was done at 80° C. for 30 minutes. A semi-bright, dense, uniform, adherent and catalytically active Pt coating of 0.1 micron thick was obtained and built-up to 3 microns. Such Pt coating is useful as a supported catalyst, a fuel cell component, and a high temperature, low friction, corrosion resistant component of aerospace engines.

COMPARATIVE EXAMPLE 3

A coupon of molybdenum 25×12×0.1 mm was polished with a sandpaper Grit 600 and immersed in an electroless Pt plating bath of the prior art as described in Comparative Example 1. No Pt plating was detected because of poor catalytic activity of molybdenum surface.

EXAMPLE 3

A coupon of molybdenum was immersed in an electroless Pt plating bath according to this invention. This bath contains 1 g/L Pt as DNP salt, 1.5 g/L $N_2H_4.H_2O$ and acetic acid $CH_3COOH$ and was adjusted to pH 6.5. Plating was done at 80° C. for 40 minutes. A semi-bright, dense, uniform, adherent and catalytically active Pt coating of 0.1 micron thick was obtained and built-up to 0.5 micron.

COMPARATIVE EXAMPLE 4

A coupon of aluminum 25×12×0.1 mm. was polished with a sandpaper Grit 600 and immersed in an electroless Pt plating bath of the prior art as described in Comparative Example 1. No Pt plating was occurred because of poor corrosion resistance of aluminum in NH4OH media.

EXAMPLE 4

A coupon of aluminum was immersed in an electroless Pt plating bath according to this invention. This bath contains 1 g/L Pt as DNP salt, 0.8 g/L $N_2H_4.H_2O$ and acetic acid $CH_3COOH$ and was adjusted to pH 6.0. Plating was done at 50° C. for 30 minutes. A matte-light-gray, dense, uniform, adherent and catalytically active Pt coating of 0.1 micron thick was obtained and built-up to 0.5 micron. Such Pt coating is useful as a low cost, lightweight supported catalyst for aerospace applications.

COMPARATIVE EXAMPLE 5

Graphite rod "ULTRA R CARBON, ULTRA F PURITY" (Ultra Carbon Co.) L50×D0.6 mm was polished with a sandpaper Grit 600 and immersed in an electroless Pt plating bath of the prior art as described in Comparative Example 1. No Pt plating was detected because of poor catalytic activity of graphite surface.

EXAMPLE 5

A graphite rod was immersed in an electroless Pt plating bath according to this invention. This bath contains 1 g/L Pt as DNP salt, 2 g/L $N_2H_4.H_2O$ and acetic acid $CH_3COOH$ and was adjusted to pH 3.5. Plating was done at 70–90° C. for 30 minutes. A matte-gray, dense, uniform, adherent and catalytically active Pt coating of 0.1 micron thick was obtained and built-up to 0.5 micron. Such Pt coating is useful as electrocatalyst and insoluble electrode for fuel cells, ultracapacitors and batteries.

COMPARATIVE EXAMPLE 6

A 350 mL glass beaker "Kimax" was cleaned by a boiling mixture HCl and HNO3, filled up with an electroless Pt plating bath of the prior art as described in Comparative Example 1, and boiled for 20 minutes. This test was repeated many times in the course of electroless Pt plating on various materials from this bath. No Pt plating on the glass beaker is detected because of poor catalytic activity of the glass surface.

EXAMPLE 6

A glass beaker was filled with an electroless Pt plating bath according to this invention. This bath contains 0.5 g/L Pt as DNP salt, 0.7 g/L $N_2H_4.H_2O$ and acetic acid CH3COOH and was adjusted to pH 5.5. Plating was done at 98° C. for 5 minutes. A bright, dense, uniform, adherent, catalytically active, nontransparent Pt mirror film of 0.05–0.1 micron thick was formed on the inside surface of the glass beaker. Such Pt coating is useful as a supported catalyst and for electronic components.

EXAMPLE 7

A molybdenum mandrel 9.08 g was sandblasted with a SiC powder Grit 600, cleaned in CCl4/ultrasonic, vapor cleaned in $CCl_4$ and immersed in an electroless Pt plating bath according to this invention. This bath contains 2 g/L Pt as DNP salt, 1.5 g/L $N_2H_4.H_2O$ and acetic acid $CH_3COOH$ and was adjusted to pH 6.82. Plating was done at 80° C. for 70 minutes. A semi-bright, dense, uniform, adherent, catalytically active Pt coating of 0.5–0.8 micron thick was obtained. Such Pt coatings are useful as high temperature resistant components for aerospace applications.

EXAMPLE 8

A titanium-aluminum alloy part 45×13×5 mm was polished with a sandpaper Grit 400, cleaned in water/ultrasonic, and immersed in an electroless Pt plating bath according to this invention. This bath contains 2 g/L Pt as DNP salt, 1.5 g/L $N_2H_4.H_2O$ and acetic acid $CH_3COOH$ and was adjusted to pH 6.8. Plating was done at 83° C. for 50 minutes. A semi-bright, dense, uniform, adherent Pt coating of 0.3–0.8 micron thick was obtained and built-up to 10 microns. Such Pt coating is useful as a high temperature resistant component for aerospace applications.

While the present invention has been particularly shown and described with reference to preferred embodiments, it will be readily appreciated by those of ordinary skill in the art that various changes and modifications may be made without departing from the spirit and scope of the invention. It is intended that the claims be to interpreted to cover the disclosed embodiment, those alternatives which have: been discussed above and all equivalents thereto.

What is claimed is:

1. An electroless plating composition comprising an aqueous solution comprising:

a) a water soluble platinum salt; and b) hydrazine hydrate;

wherein said composition has a pH of about 7 or less.

2. The plating composition of claim 1 wherein the composition has a pH of from about 0.5 to about 7.

3. The plating composition of claim 1 which comprises an acid.

4. The plating composition of claim 3 wherein the acid comprises acetic acid or nitric acid, or a combination thereof.

5. The plating composition of claim 1 wherein the water soluble platinum salt comprises a platinum nitrite salt, a platinum ammine nitrite salt or a combination thereof.

6. The plating composition of claim 1 wherein the platinum salt comprises diamminebis(nitrito-N,N) platinum (II).

7. The plating composition of claim 1 wherein the platinum salt is present in an amount ranging from about 0.01 to about 120 g/L.

8. The plating composition of claim 1 wherein hydrazine hydrate is present in an amount ranging from about 0.01 to about 240 g/L.

9. A process for plating a substrate comprising:

A) providing a plating composition comprising an aqueous solution comprising:

a) a water soluble platinum salt; and b) hydrazine hydrate;

wherein said composition has a pH of about 7 or less; and

B) contacting a substrate with the plating composition for a sufficient time and under conditions sufficient to plate metallic platinum onto the substrate.

10. The process of claim 9 wherein the plating composition is autocatalytic.

11. The process of claim 9 wherein the substrate is uniformly plated with metallic platinum.

12. The process of claim 9 wherein the temperature of the plating composition ranges from about 15° C. to about 98° C.

13. The process of claim 9 wherein the plating composition has a pH of from about 0.5 to about 7.

14. The process of claim 9 wherein the plating composition comprises an acid.

15. The process of claim 14 wherein the acid comprises acetic acid or nitric acid, or a combination thereof.

16. The process of claim 9 wherein the plating composition comprises a platinum nitrite salt, a platinum ammine nitrite salt or a combination thereof.

17. The process of claim 9 wherein the plating composition comprises diamminebis(nitrito-N,N) platinum (II).

18. The process of claim 9 wherein the platinum salt is present in an amount ranging from about 0.01 to about 120 g/L.

19. The process of claim 9 wherein hydrazine hydrate is present in an amount ranging from about 0.01 to about 240 g/L.

20. The process of claim 9 which is conducted without electrolysis.

21. The process of claim 9 wherein the substrate comprises a metal.

22. The process of claim 9 wherein the substrate comprises a non-metal.

23. The process of claim 9 wherein the substrate comprises a semiconductor.

24. The process of claim 9 wherein the substrate comprises a ceramic.

25. A process for plating a substrate comprising:

A) providing a plating composition comprising an aqueous solution comprising:

a) a water soluble platinum salt; and b) hydrazine hydrate;

wherein said composition has a pH of about 7 or less;

B) immersing a substrate into the plating composition for a sufficient time and under conditions sufficient to plate metallic platinum onto the substrate; and C) removing the substrate from the plating composition.

26. An article comprising a substrate immersed in a composition comprising an aqueous solution comprising:

a) a water soluble platinum salt; and b) hydrazine hydrate;

wherein said composition has a pH of about 7 or less.

* * * * *